US008882101B2

(12) United States Patent
Cho

(10) Patent No.: US 8,882,101 B2
(45) Date of Patent: Nov. 11, 2014

(54) LEVER ASSEMBLY, IMAGE FORMING APPARATUS HAVING THE SAME, AND SOLENOID USED IN THE SAME

(75) Inventor: Byung-hee Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 542 days.

(21) Appl. No.: 12/013,503

(22) Filed: Jan. 14, 2008

(65) Prior Publication Data

US 2008/0257100 A1 Oct. 23, 2008

(30) Foreign Application Priority Data

Apr. 23, 2007 (KR) ..... 10-2007-39369

(51) Int. Cl.
*B65H 3/06* (2006.01)
*H01F 7/16* (2006.01)

(52) U.S. Cl.
CPC ..... *B65H 3/0669* (2013.01); *B65H 2601/324* (2013.01); *H01F 7/1607* (2013.01); *B65H 2403/511* (2013.01); *B65H 2555/13* (2013.01); *B65H 2402/10* (2013.01); *B65H 2403/47* (2013.01)
USPC ..... 271/114

(58) Field of Classification Search
USPC ..... 271/21, 109, 114, 115, 145, 156
See application file for complete search history.

(56) References Cited

U.S. PATENT DOCUMENTS

| | | | | |
|---|---|---|---|---|
| 3,815,900 | A | 6/1974 | Schulze | |
| 3,848,907 | A | 11/1974 | Shiurila | |
| 4,216,454 | A * | 8/1980 | Ohtani et al. | 335/262 |
| 4,529,188 | A * | 7/1985 | Sturnick | 271/10.12 |
| 5,358,230 | A * | 10/1994 | Ikemori et al. | 271/114 |
| 5,876,073 | A | 3/1999 | Geringer et al. | |
| 6,070,867 | A * | 6/2000 | Tsurumi et al. | 271/114 |
| 6,624,733 | B1 | 9/2003 | Swenson, Jr. | |
| 7,270,323 | B2 * | 9/2007 | Somemiya | 271/127 |
| 2005/0189698 | A1 * | 9/2005 | Somemiya | 271/109 |
| 2006/0038645 | A1 * | 2/2006 | Hoffman | 335/220 |

FOREIGN PATENT DOCUMENTS

| | | | |
|---|---|---|---|
| EP | 1552948 | | 7/2005 |
| GB | 2195614 | | 4/1988 |
| JP | 57-145735 | * | 9/1982 |
| JP | 58-6856 | * | 1/1983 |
| JP | 59-92835 | * | 5/1984 |
| JP | 62-100334 | * | 5/1987 |
| JP | 62-215439 | * | 9/1987 |
| JP | 1-233712 | * | 9/1989 |
| JP | 7-106799 | | 11/1995 |
| JP | 2002-240971 | * | 8/2002 |

OTHER PUBLICATIONS

Machine translation of JP 2002-240971.*

Korean Notice of Preliminary Rejection dated May 4, 2011 to Korean Patent Application No. 10-2007-0039369.

Partial European Search Report, mailed Oct. 4, 2010, in corresponding European Application 08101618.0 (5 pp.).

* cited by examiner

*Primary Examiner* — Thomas Morrison
(74) *Attorney, Agent, or Firm* — Staas & Halsey LLP

(57) ABSTRACT

A lever assembly controls a pickup roller, and includes a lever, a solenoid to actuate the lever, and a supporting plate on which the lever is rotatably disposed and to which the solenoid is connected at one side of the lever.

3 Claims, 5 Drawing Sheets

LEVER ASSEMBLY, IMAGE FORMING APPARATUS HAVING THE SAME, AND SOLENOID USED IN THE SAME

CROSS-REFERENCE TO RELATED APPLICATION

This application claims the benefit of Korean Application No. 2007-39369, filed Apr. 23, 2007 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a lever assembly used in the image forming apparatus, the image forming apparatus having the same, and a solenoid used in the lever assembly.

2. Description of the Related Art

Generally, an image forming apparatus has a pickup roller that picks up printing media one by one from a printing media cassette. A pickup roller control unit controls the pickup roller to rotate so that the pickup roller picks up the loaded printing media one by one to feed an image forming unit according to a signal from a controller of the image forming apparatus.

The conventional pickup roller control unit uses a solenoid as an actuator to control rotation of the pickup roller according to the signal from the controller of the image forming apparatus. Here, "to control rotation of the pickup roller" refers to rotating or stopping the pickup roller according to the signal from the controller of the image forming apparatus.

Generally, in the conventional pickup roller control unit, a connecting part or a lever that holds a rotation shaft of the pickup roller to stop the pickup roller according to motion of the solenoid is disposed between the solenoid and the rotation shaft of the pickup roller. As a result, in the conventional pickup roller control unit, the controller of the image forming apparatus controls the solenoid, thereby controlling the rotation of the pickup roller.

In the conventional pickup roller control unit, the connecting part or lever to hold the rotation shaft of the pickup roller and the solenoid to actuate the connecting part or lever are separately formed from each other, and disposed directly on a main body frame of the image forming apparatus. Because the conventional pickup roller control unit and the solenoid are separately installed on the main body frame of the image forming apparatus, it is difficult to install the pickup roller control unit on the image forming apparatus.

Additionally, because the conventional pickup roller control and the solenoid are separately installed on the main body frame of the image forming apparatus, if a portion of the main body frame in which the lever or connecting part is installed is not precisely machined, the relative position between the lever or connecting part and the solenoid may deviate from the designed positions. When the relative position between the lever or connecting part and the solenoid deviates, the solenoid cannot operate smoothly. Also, when the relative position between the lever or connecting part and the solenoid deviates from the designed positions, the pulling force with which the solenoid pulls the lever or connecting part may decrease.

SUMMARY OF THE INVENTION

Aspects of the present invention have been developed in order to overcome the above drawbacks and other problems associated with the conventional arrangement. Aspects of the present invention provide a solenoid assembly that has been adapted to be assembled easily and to operate smoothly, an image forming apparatus having the same, and a solenoid used in the solenoid assembly.

This aspect and/or other features of the present invention can substantially be achieved by providing a lever assembly including a lever; a solenoid to actuate the lever where the solenoid is fixed to at one side of the lever; and a supporting plate where the lever is rotatably disposed. The lever may be rotatably supported by a lever axis formed on the supporting plate.

The solenoid includes: a plunger connected with the lever; a coil disposed to wrap around the plunger and to pull the plunger when electric power is applied to the coil; a frame to which the coil is attached, where the bottom plate of the frame has a plunger hole through which a second end of the plunger passes. One side plate of the frame may be extended to form the supporting plate in one single part with the frame.

The frame may be formed in a substantially flat U shape to enclose the coil, and one side plate of the substantially flat U shape of the frame may be extended to form the supporting plate. The frame may include a holding cap to hold both top ends of the substantially flat U shape. Also, the frame may include a projection port to project from the bottom plate of the frame around the plunger hole.

The lever assembly may have an elastic member that is disposed at the plunger and a plurality of attachment holes that is formed at the supporting plate.

According to another aspect of the present invention, an image forming apparatus includes: a pickup roller shaft on which a pickup roller is disposed; a pickup gear disposed at one end of the pickup roller shaft with a pickup cam; a lever assembly disposed at one side of the pickup cam to control rotation of the pickup gear, the lever assembly including a lever and a solenoid to actuate the lever; and a supporting plate on which the lever is rotatably disposed and where the solenoid is connected to one side of the lever; and an image forming unit to form images on a printing medium that is picked up by the pickup roller.

According to another aspect of the present invention, a solenoid includes: a plunger; a coil disposed to wrap around the plunger and to pull the plunger when electric power is applied to the coil; a frame to which the coil is attached, with a hole in the bottom plate of the frame through which a second end of the plunger passes; and a projection port to project from the bottom plate of the frame around the plunger hole. The pulling force distance may be extended to as much as the height of the projection port.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
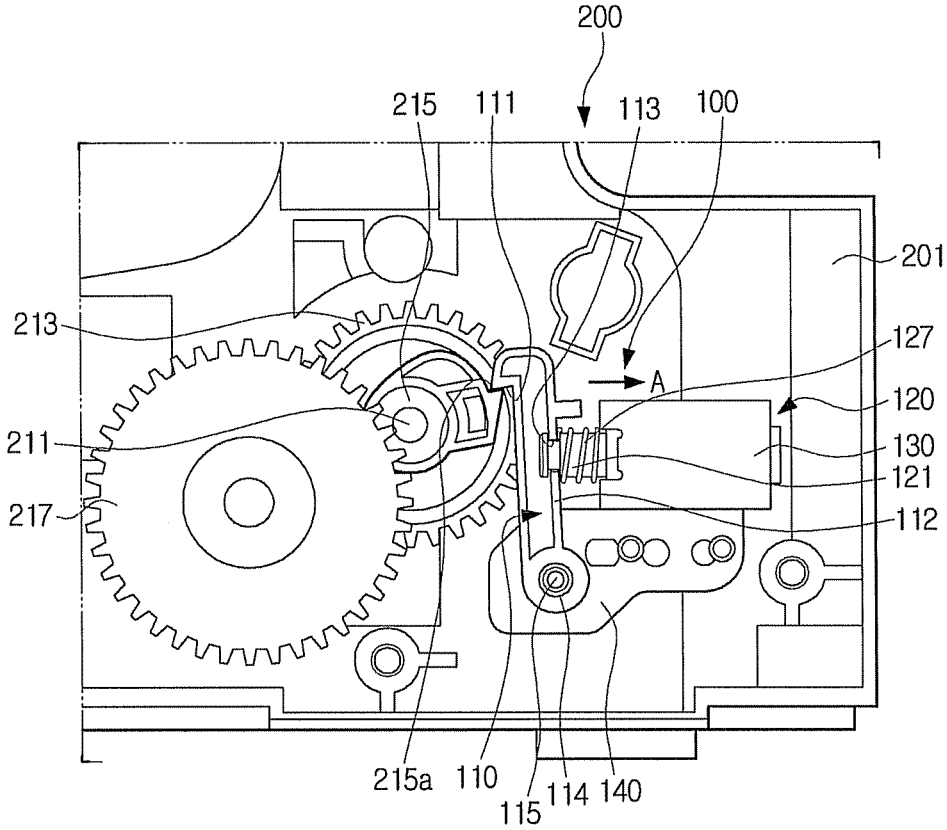
FIG. 1 is a side view illustrating a lever assembly disposed on an image forming apparatus according to an embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 2:
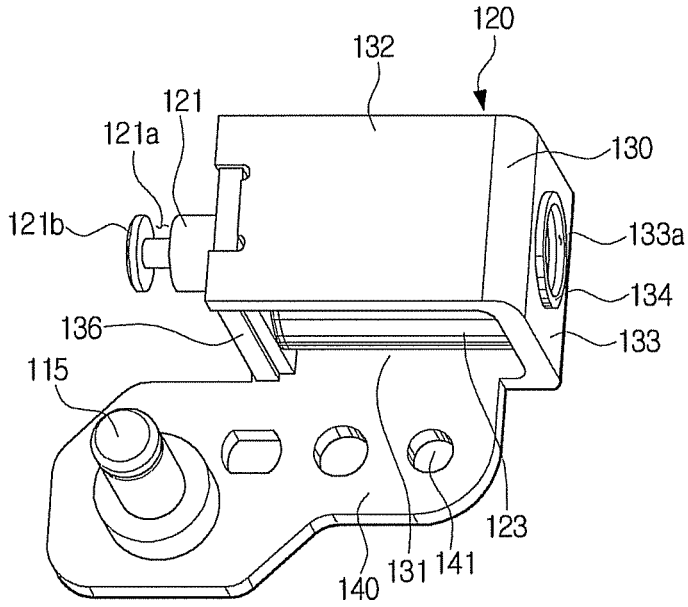
FIG. 2 is a perspective view illustrating the lever assembly of FIG. 1 without the lever.

Referring to FIGS. 1 and 2, a lever assembly 100 according to an embodiment of the present invention includes a lever 110, a solenoid 120, and a supporting plate 140. The lever 110 controls rotation of a pickup roller 212 (see FIG. 6) together with a pickup cam 215 disposed at a pickup roller shaft 211, and is rotatably disposed at the supporting plate 140. The lever 110 has a first end at which a hook 111 is formed to be hooked on a hooking projection 215*a* of the pickup cam 215, and a second end at which a lever hole 114 is formed to be placed over a lever axis 115 disposed at the supporting plate 140. A connection opening 113 to which a first end 121*b* of a plunger 121 of the solenoid 120 is connected is formed at a side surface 112 of the lever 110. Therefore, when the plunger 121 of the solenoid 120 moves back and forth within a coil 123 (see FIGS. 2-4), the lever 110 pivots on the lever axis 115 by a predetermined angle. The solenoid 120 operates the lever 110 according to a signal from a controller (not illustrated) of the image forming apparatus 200 to allow the controller of the image forming apparatus 200 to selectively rotate the pickup roller 212.

Figure 3:
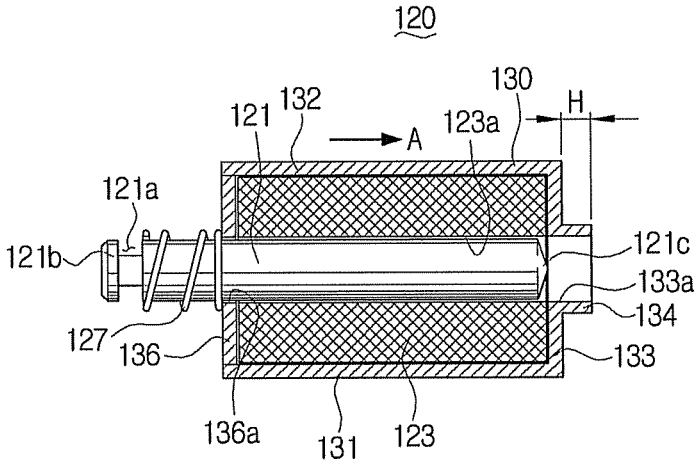
FIG. 3 is a sectional view illustrating a solenoid of the image forming apparatus of FIG. 1.

Referring now as well to FIG. 3, the solenoid 120 has the plunger 121 and a body comprising the coil 123 and a frame 130. The plunger 121 moves linearly inside the coil 123, and is formed of a material that can be attracted by magnetic force. The plunger 121 is formed in a substantially cylindrical rod shape, and has a connection groove 121*a* formed near the first end 121*b* of the plunger 121 that is inserted into the connection opening 113 of the lever 110. When the connection groove 121*a* of the plunger 121 is inserted in the connection opening 113 of the lever 110, the first end 121*b* of the plunger 121 is hooked on the side surface 112 of the lever 110 so that the lever 110 and the plunger 121 are connected with each other.

An elastic member 127 is disposed between a portion near the first end 121*b* of the plunger 121 and the frame 130 of the solenoid 120. The elastic member 127 elastically restores the plunger 121 to a position projected from the frame 130 of the solenoid 120. As a result, when electric power is applied to the coil 123, the plunger 121 is moved toward the coil 123 (in the direction of arrow A in FIGS. 1 and 3) by magnetic force of the coil 123, and then, when the electric power is off, the plunger 121 is restored to the original position by the elastic member 127. Therefore, the elastic member 127 must have elasticity such that the elastic member 127 can press the lever 110 toward the pickup cam 215, and can be compressed when the plunger 121 is pulled by the magnetic force of the solenoid 120. A coil spring capable of inserting the plunger 121 into the coil 123 may be used as the elastic member 127.

The coil 123 is disposed to wrap around the plunger 121. When electric power is applied to the coil 123, the coil 123 is configured to pull the plunger 121 toward itself, that is, in the direction of arrow A in FIGS. 1 and 3. In this embodiment, the coil 123 is formed in a substantially hollow cylindrical shape 123*a*, and the plunger 121 moves within the hollow 123*a* of the coil 123. The coil 123 is formed such that when electric power is applied to the coil 123, magnetic force generates in the hollow 123*a* of the coil 123 to attract the plunger 121 in the direction of arrow A in FIGS. 1 and 3. Although not illustrated, the coil 123 is connected with an electric wire through which the electric power is applied from the outside.

The frame 130 forms the external appearance of the solenoid 120 and holds the coil 123. In this embodiment, as illustrated in FIG. 2, the frame 130 is formed in a substantially flat U shape. The coil 123 is disposed between both arms 131 and 132 (hereinafter, referred to as both side plates) that form the substantially flat U shape of the frame 130, and both side plates 131 and 132 are attached to a bottom plate 133 to create the U shape of the frame 130. Also, the frame 130 has a holding cap 136 that holds both side plates 131 and 132. The holding cap 136 fits into notches in the top ends of each of both side plates 131 and 132 of the frame 130 and holds the side plates 131 and 132 in position so that the gap between both side plates 131 and 132 of the frame 130 does not widen and so the coil 123 disposed therebetween does not come out. An opening 136*a* is formed substantially at the center of the holding cap 136 so that the plunger 121 can freely move within the coil 123 through the opening 136*a*.

A plunger hole 133*a* is formed in the bottom plate 133 of the frame 130 through which a second end 121*c* of the plunger 121 can pass. A projection port 134 may be formed around the plunger hole 133*a* to project outside from the bottom plate 133 of the frame 130. The projection port 134 is formed integrally with the frame 130. The projection port 134 may be formed by a burring process when the plunger hole 133*a* of the frame 130 is machined using a press machine. The projection port 134 that is formed on the bottom plate 133 of the frame 130 allows the pulling force distance to be extended. Here, the pulling force distance refers to the distance through which the pulling force operates for the coil 123 pulling the plunger 121. For example, when a dimension of height H (see FIG. 3) of projection port 134 from the bottom plate 133 is 2 mm, the pulling force distance in which the magnetic force of the coil 123 can affect the plunger 121 is extended by 2 mm. To extend the pulling force distance using the projection port 134 allows the pulling force to operate the plunger 121 to be increased and the moving distance of the plunger 121 to be lengthened.

Here, the pulling force of the coil 123 refers to the magnetic force that is generated in the coil 123 when electric power is applied to the coil 123, and pulls the plunger 121 in the direction of arrow A in FIGS. 1 and 3. In general, if the coil 123 is disposed inside the frame 130, the magnetic force that is generated by the coil 123 to pull the plunger 121 in the direction of arrow A, has its maximum value at the bottom plate 133 of the frame 130. Therefore, the pulling force that is applied to the plunger 121 by the coil 123 theoretically becomes zero when the second end 121*c* of the plunger 121 is pulled outside the bottom plate 133 of the frame 130.

Therefore, in this aspect of the present invention, in order to extend the distance where the pulling force of the coil 123 operates, that is, the pulling force distance, the projection port 134 is formed around the plunger hole 133*a* of the bottom plate 133 of the frame 130 through which the second end 121*c* of the plunger 121 passes. The height H of the projection port 134 may be any dimension suitable for the purpose described herein. Furthermore, in this embodiment, the projection port 134 is formed on the bottom plate 133 of the frame 130. Alternatively, to extend the pulling force distance, the bottom plate 133 of the frame 130 may be formed to be thicker than that of the bottom plate 133 of the frame 130 as described in the above embodiment, up to the height H of the above-described projection port 134. However, in this case, the frame 130 must be made of a thicker material so that the weight of the lever assembly 100 becomes too heavy.

The supporting plate 140 supports the lever 110 to rotate the lever axis 115 and the solenoid 120. That is, the lever axis 115, the lever 110 and the solenoid 120 are disposed on the same supporting plate 140 so that the relative position between the rotation center of the lever 110, that is, the center of the lever axis 115, and the solenoid 120 is determined by the supporting plate 140. Therefore, the relative position between the rotation center of the lever 110 and the solenoid 120 is not affected by the exact dimensions of the main body frame 201 of the image forming apparatus 200 (see, particularly, FIG. 6). As a result, the relative positioning between the lever 110 and plunger 121 can easily be controlled.

The supporting plate 140 may be formed as a separate part. Alternatively, the supporting plate 140 may be formed as one single part along with the frame 130 of the solenoid 120. In the embodiment shown in FIG. 2, one side plate 131 of the frame 130 of the solenoid 120 is extended to form the supporting plate 140 so that the supporting plate 140 and the frame 130 of the solenoid 120 are formed in one single part. If the supporting plate 140 and the solenoid frame 130 are formed in one single part, it is relatively simple to assemble the lever assembly 100.

The lever axis 115 is disposed on the supporting plate 140. The lever hole 114 that is formed at the second end of the lever 110 is placed on the lever axis 115. Therefore, the lever 110 can rotate on the lever axis 115. Also, a plurality of connecting holes 141 is formed on the supporting plate 140 where the connecting holes 141 are used to connect the supporting plate 140 to the main body frame 201 of the image forming apparatus 200.

Hereinafter, operation of the lever assembly 100 according to this aspect of the present invention will be explained with reference to FIGS. 1 through 4. When the controller (not illustrated) of the image forming apparatus 200 applies electric power to the coil 123 of the solenoid 120, the coil 123 generates a magnetic force to cause the plunger 121 to move in the direction of arrow A. In this situation, if the frame 130 of the solenoid 120 is provided with the projection port 134 formed on the bottom plate 133 thereof, the second end 121*c* of the plunger 121 (see FIG. 3) is pulled by a stronger pulling force.

Figure 4:
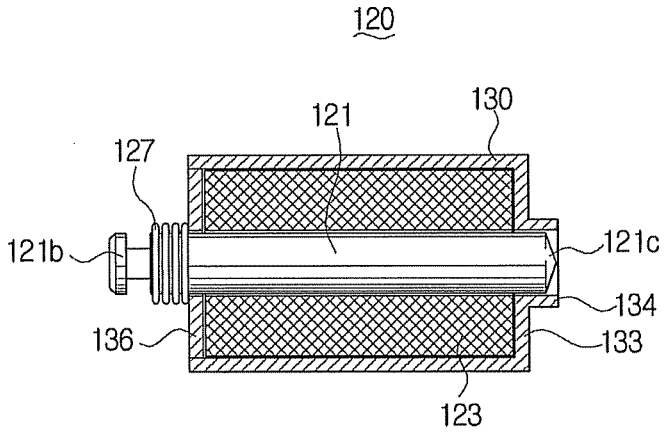
FIG. 4 is a sectional view illustrating the solenoid of FIG. 3, the plunger of which is pulled to a coil.

When the plunger 121 moves in the direction of arrow A, the lever 110 connected to the first end 121*b* of the plunger 121 rotates on the lever axis 115 in the clockwise direction. When the plunger 121 moves entirely inside the coil 123 (as illustrated in FIG. 4), the hook 111 of the lever 110 leaves the hooking projection 215*a* of the pickup cam 215. Then, a pickup gear 213, along with the pickup cam 215, is rotated by rotation force that is transferred from a pickup driving gear 217.

After the hook 111 of the lever 110 leaves the hooking projection 215*a* of the pickup cam 215, the controller of the image forming apparatus 200 turns off the electric power to be applied to the coil 123. Then, the plunger 121 is moved in the reverse direction of arrow A as a result of the elasticity of the elastic member 127 so as to be restored to the original position near the pickup cam 215. When the pickup gear 213 continues to rotate, the hooking projection 215*a* of the pickup cam 215 is hooked on the hook 111 of the lever 110. When the hooking projection 215*a* of the pickup cam 215 is hooked on the hook 111 of the lever 110, the pickup gear 213 stops rotating.

Therefore, with the lever assembly 100 formed according to this aspect of the present invention, when the lever 110 and the solenoid 120 are disposed on the same supporting plate 140, the solenoid 120 can smoothly operate the lever 110, unaffected by the exact measurements of the main body frame 201 of the image forming apparatus 200.

Figure 5:
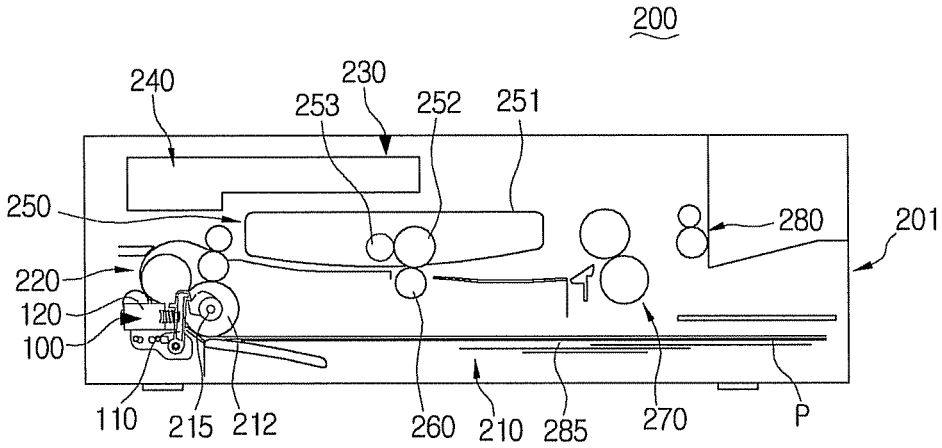
FIG. 5 is a sectional view schematically illustrating the image forming apparatus of FIG. 1 on which the lever assembly is disposed.
Figure 6:
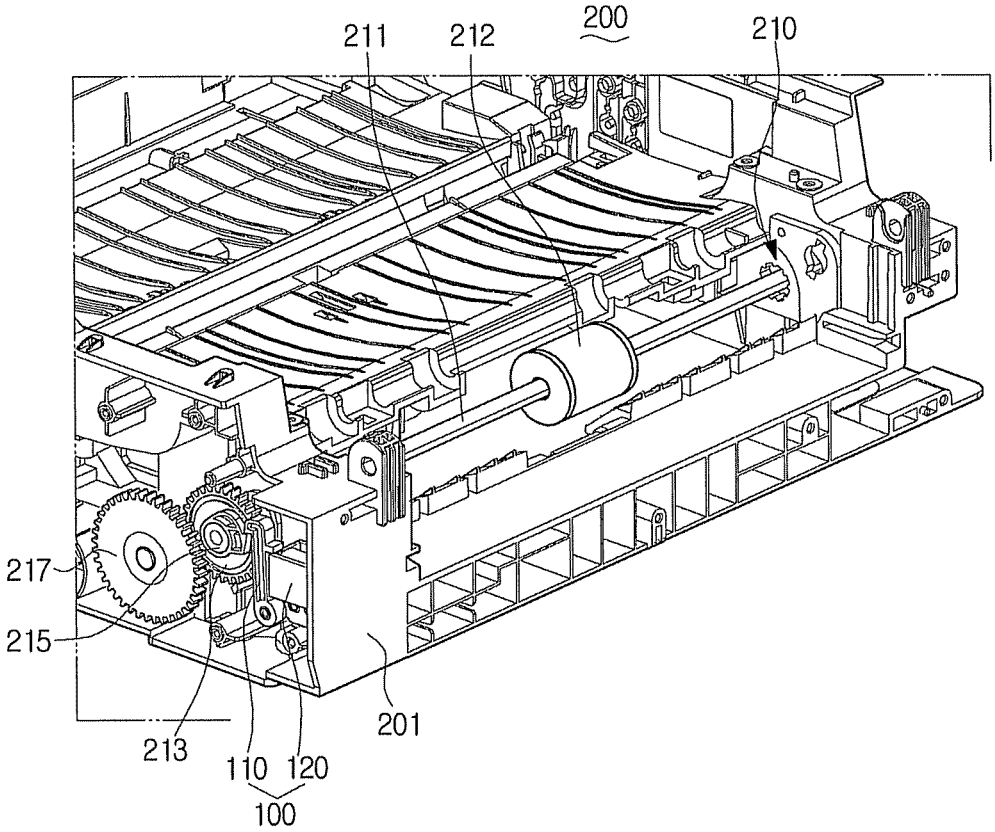
FIG. 6 is a partial perspective view illustrating a portion of the image forming apparatus of FIG. 5 on which the lever assembly is disposed.

Hereinafter, the image forming apparatus 200 having the lever assembly 100 according to an embodiment of the present invention will be explained. FIG. 5 is a sectional view schematically illustrating the image forming apparatus 200 on which the lever assembly 100 is disposed according to this aspect of the present invention, and FIG. 6 is a partial perspective view illustrating a portion of the image forming apparatus 200 on which the lever assembly 100 is disposed.

Referring to FIG. 5, the image forming apparatus 200 having the lever assembly 100 according to this aspect of the present invention includes the main body frame 201, a printing medium feeding unit 210, a conveying roller unit 220, an image forming unit 230, a fixing unit 270, and a discharging unit 280. The main body frame 201 forms the external appearance of the image forming apparatus 200. The printing medium feeding unit 210, the conveying roller unit 220, the image forming unit 230, the fixing unit 270, and the discharging unit 280 are disposed inside the main body frame 201.

The printing medium feeding unit 210 picks up printing media P one by one and feeds a picked up printing medium P to the conveying roller unit 220. The printing medium feeding unit 210 includes a printing medium cassette 285 in which a plurality of printing media P is loaded, a pickup roller 212 that is disposed at a leading end of the printing medium cassette 285, and the lever assembly 100 that controls rotation of the pickup roller 212 so that the controller of the image forming apparatus 200 can intermittently rotate the pickup roller 212.

The pickup roller 212 is disposed along the pickup roller shaft 211, and the pickup gear 213 is disposed at one end of the pickup roller shaft 211. The pickup cam 215 is disposed at one side surface of the pickup gear 213 to control rotation of the pickup roller 212 together with the lever assembly 100. Alternatively, the pickup cam 215 may be formed integrally with the pickup gear 213 at one side surface of the pickup gear 213. The pickup cam 215 has the hooking projection 215*a* (see FIG. 1) on which the hook 111 of the lever 110 is hooked. Therefore, when the hook 111 of the lever 110 is hooked on the hooking projection 215*a* of the pickup cam 215, the pickup roller 212 cannot rotate. When the hook 111 of the lever 110 leaves the hooking projection 215*a* of the pickup cam 215, the pickup roller 212 can rotate.

The pickup gear 213 is disposed to engage with the pickup driving gear 217 that is disposed at one side of the pickup gear 213. The pickup driving gear 217 receives power from a driving motor (not illustrated) in order to rotate.

The lever assembly 100 is disposed at one side of the pickup cam 215 to control the rotation of the pickup roller 212 according to a signal from the controller of the image forming apparatus 200. The lever assembly 100 includes the lever 110, the solenoid 120, and the supporting plate 140. The structure and operation of the lever assembly 100 are not explained in detail here since they were previously described above in detail.

The conveying roller unit 220 includes at least one pair of conveying rollers, and conveys the printing medium P to be picked up by the pickup roller 212 of the printing medium feeding unit 210 to the image forming unit 230. The image forming unit 230 forms images on the printing medium P, and includes a light exposure unit 240, a developing cartridge 250, and a transferring roller 260.

The developing cartridge 250 has a housing 251, and a photosensitive medium 252 and a developing roller 253 that are rotatably disposed inside the housing 251. The developing cartridge 250 develops electrostatic latent images, which are formed on the photosensitive medium 252 by laser beam emitted from the light exposure unit 240, into toner images.

The transferring roller 260 is rotatably disposed to contact the photosensitive medium 252 below the developing cartridge 250, and causes the toner images on the photosensitive medium 252 to be transferred onto the printing medium P conveyed from the printing medium feeding unit 210. The fixing unit 270 includes a pressure roller and a heat roller, and applies high heat and high pressure to the printing medium P passing through between the pressure and heat rollers so that the transferred toner images are fixed onto the printing medium P. The discharging unit 280 discharges the printing medium P, which has the images fixed thereon when passing through the fixing unit 270, to the outside of the image forming apparatus 200.

Hereinafter, operation of the image forming apparatus 200 with the above-described structure will be explained with reference to FIGS. 5 and 6. The controller (not illustrated) of the image forming apparatus 200 receives a printing order from a host computer (not illustrated) connected with the image forming apparatus 200. When receiving the printing order with printing data, the controller of the image forming apparatus 200 operates the light exposure unit 240 to emit a laser beam corresponding to the printing data.

The laser beam emitted from the light exposure unit 240 enters the photosensitive medium 252 of the developing cartridge 250 to form electrostatic latent images corresponding to the printing data on a surface of the photosensitive medium 252. The electrostatic latent images on the photosensitive medium 252 are developed into toner images with toner that the developing roller 253 disposed inside the developing cartridge 250 supplies. Also, when receiving the printing order, the controller of the image forming apparatus 200 operates the printing medium feeding unit 210 to pick up a printing medium P from the loaded printing media P and to feed the picked up printing medium P to the conveying roller unit 220.

The process in which the printing medium feeding unit 210 picks up one printing medium P will now be described in detail. When receiving the printing order, the controller of the image forming apparatus 200 applies electric power to the coil 123 of the solenoid 120 of the lever assembly 100. When the electric power is applied to the coil 123, the plunger 121 is pulled toward the coil 123 so that the lever 110 rotates on the lever axis 115.

The lever 110 rotates toward the solenoid 120 so that the hook 111 of the lever 110 leaves the hooking projection 215*a* of the pickup cam 215. When the hook 111 of the lever 110 leaves the hooking projection 215*a*, the pickup gear 213 that is engaged with the pickup driving gear 217 rotates. When the pickup gear 213 rotates, the pickup roller 212 disposed on the same shaft 211 as the pickup gear 213 also rotates. When the pickup roller 212 rotates, one printing medium P is picked up from the printing medium cassette 285 and fed to the conveying roller unit 220.

When the plunger 121 is completely pulled to the coil 123 as illustrated in FIG. 4 so that the hook 111 of the lever 110 leaves the hooking projection 215*a* of the pickup cam 215, the controller of the image forming apparatus 200 turns off the electric power that is being applied to the coil 123 of the solenoid 120. Then, the plunger 121 is moved toward the pickup cam 215 as a result of the elasticity of the elastic member 127 so as to be restored to the original position near the pickup cam 215.

When the pickup roller 212 continues to rotate, the hooking projection 215*a* of the pickup cam 215 is hooked on the hook 111 of the lever 110. When the hooking projection 215*a* of the pickup cam 215 is hooked on the hook 111 of the lever 110, the pickup roller 212 stops rotating.

After that, when the controller of the image forming apparatus 200 applies electric power to the coil 123 of the solenoid 120, the pickup roller 212 makes one revolution to again pick up one printing medium P. The printing medium P that is picked up by the pickup roller 212 passes through the conveying roller unit 220 and enters between the transferring roller 260 and the photosensitive medium 252 of the developing cartridge 250. When the printing medium P enters between the photosensitive medium 252 of the developing cartridge 250 and the transferring roller 260, the toner images on the photosensitive medium 252 are transferred onto the printing medium P. The printing medium P with the toner images transferred thereon moves to the fixing unit 270. When the printing medium P passes through between the pressure and heat rollers of the fixing unit 270, the toner images are fixed onto the printing medium P. The printing medium P with the toner images fixed thereon is discharged to outside the image forming apparatus 200 via the discharging unit 280.

In the above-description, an electro photographic image forming apparatus is described as an apparatus in which the lever assembly according to aspects of the present invention can be used; however, this should not be considered as limiting. Alternatively, the lever assembly according to aspects of the present invention can be used in inkjet printers. In other words, the lever assembly according to aspects of the present invention can be used in various image forming apparatuses such as copiers, composite apparatuses, facsimiles, etc. that have a function intermittently picking up printing media one by one.

With the lever assembly according to aspects of the present invention and the image forming apparatus having the same as described above, since the lever and solenoid are disposed on the same supporting plate, the lever can smoothly operate regardless of the exact measurements of the main body frame of the image forming apparatus.

Also, with the image forming apparatus according to aspects of the present invention, the lever and solenoid are assembled to form the lever assembly, and then the lever assembly is assembled on the main body frame of the image forming apparatus. Therefore, assembly of the image forming apparatus according to aspects of the present invention is more convenient than that of a conventional image forming apparatus configured so that the lever and solenoid are directly disposed at the main body frame thereof.

Additionally, with the solenoid according to aspects of the present invention, the range of the pulling force distance thereof can be adjusted by design of the height of the projection port that is formed on the bottom plate of the frame so that it is easy to manufacture the solenoid. Furthermore, it is not required to use a thick material in order to manufacture the frame of the solenoid so that weight of the solenoid may be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a main body frame;

a roller shaft along which a pickup roller is disposed and which is rotatably disposed in the main body frame;

a pickup gear disposed at one end of the roller shaft;

a pickup cam disposed at the pickup gear;

a lever assembly disposed at one side of the pickup cam to control rotation of the pickup gear; and an image forming unit to form images on a printing medium that is picked up by the pickup roller, the lever assembly comprising:

a lever comprising a first end to contact the pickup cam, a second end, and a connection opening formed between the first and second ends at a side surface of the lever, a solenoid to actuate the lever comprising a solenoid frame to which a coil is attached, and a supporting plate, detachably disposed on the main body frame, on which the lever is rotatably connected to a lever axis which protrudes from the supporting plate, wherein the lever rotatably connects to the lever axis via a lever hole formed at the second end of the lever, wherein a first side plate of the solenoid frame is integrally formed together with the supporting plate as one single part and a bottom plate of the solenoid is integrally formed together with the support plate as one single part, and the roller shaft does not pass through the supporting plate, wherein the solenoid frame further comprises a plunger hole disposed at the bottom plate of the solenoid frame through which a plunger passes, a projection port formed so that an inner surface of the plunger hole is extended to project from the bottom plate of the frame, and the plunger hole is thicker than the bottom plate of the frame.

2. The image forming apparatus of claim 1, wherein the solenoid frame further comprises a holding cap to hold a top end of at least one side plate of the solenoid frame.

3. The image forming apparatus of claim 1, wherein the solenoid frame further comprises:

a second side plate opposite of the first side plate connected to the bottom plate of the solenoid frame; and a holding cap, disposed opposite of the bottom plate, in notches of the first and second side plates, to hold the first and second side plates, and having an opening through which the plunger of the solenoid passes.

* * * * *